US011396812B2

(12) United States Patent
Ramm

(10) Patent No.: US 11,396,812 B2
(45) Date of Patent: Jul. 26, 2022

(54) FLOW CHANNEL FOR A TURBOMACHINE

(71) Applicant: MTU Aero Engines AG, Munich (DE)

(72) Inventor: Guenter Ramm, Eichenau (DE)

(73) Assignee: MTU Aero Engines AG, Munich (DE)

( * ) Notice: Subject to any disclaimer, the term of this patent is extended or adjusted under 35 U.S.C. 154(b) by 853 days.

(21) Appl. No.: 16/204,954

(22) Filed: Nov. 29, 2018

(65) Prior Publication Data

US 2019/0169989 A1 Jun. 6, 2019

(30) Foreign Application Priority Data

Dec. 1, 2017 (DE) ..... DE10 2017 221 684

(51) Int. Cl.
*F01D 9/02* (2006.01)
*F01D 1/02* (2006.01)
(Continued)

(52) U.S. Cl.
CPC ..... *F01D 1/023* (2013.01); *F01D 5/142* (2013.01); *F01D 5/148* (2013.01); *F01D 5/16* (2013.01);
(Continued)

(58) Field of Classification Search
CPC ..... F01D 5/142; F01D 5/148; F01D 1/023; F01D 5/16; F01D 9/02; F01D 9/041;
(Continued)

(56) References Cited

U.S. PATENT DOCUMENTS 5,984,631 A * 11/1999 Toigos ..... F01D 5/142 415/194
6,439,838 B1 * 8/2002 Crall ..... F01D 9/02 415/119
(Continued)

FOREIGN PATENT DOCUMENTS

DE 3942203 A1 7/1990
DE 50112824 T2 3/2006
(Continued)

OTHER PUBLICATIONS

Santner, C., et al., "Evolution of the flow through a turning mid turbine frame applied between a transonic HPTurbine stage and a counter-rotating LP-Turbine," Institute for Thermal Turbomachinery and Machine Dynamics Graz University of Technology, Austria; ETC 2011.
(Continued)

*Primary Examiner* — J. Todd Newton
*Assistant Examiner* — Theodore C Ribadeneyra
(74) *Attorney, Agent, or Firm* — Barlow, Josephs & Holmes, Ltd.; David R. Josephs

(57) ABSTRACT

The present invention relates to a method for designing a flow channel for a turbomachine, in particular a gas turbine that comprises a guide vane cascade having a plurality of guide vanes, which are distributed in the peripheral direction, and flow passages, each of which is bounded by two successive guide vanes, and a support rib arrangement having at least one support rib, wherein a design of one of
(Continued)

Figure 1:
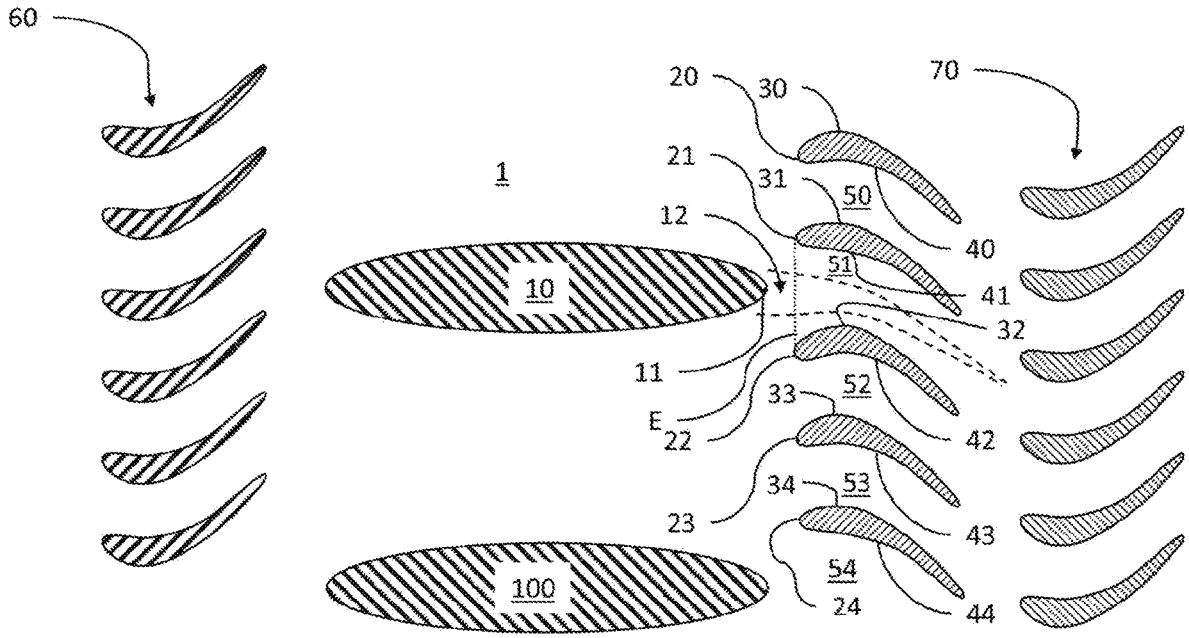

the flow passages is adapted to this support rib, that it is situated downstream of, in order to reduce a pressure loss and/or a vibrational stimulation.

8 Claims, 2 Drawing Sheets

(51) Int. Cl.

| | |
|---|---|
| ***F01D 5/14*** | (2006.01) |
| ***F01D 25/04*** | (2006.01) |
| ***F01D 5/16*** | (2006.01) |
| ***F01D 9/04*** | (2006.01) |
| ***F01D 9/06*** | (2006.01) |
| ***F01D 25/28*** | (2006.01) |

(52) U.S. Cl.
CPC ..... *F01D 9/02* (2013.01); *F01D 9/041* (2013.01); *F01D 9/065* (2013.01); *F01D 25/04* (2013.01); *F01D 25/28* (2013.01); *F05D 2220/323* (2013.01); *F05D 2240/12* (2013.01); *F05D 2240/128* (2013.01); *F05D 2250/30* (2013.01); *F05D 2260/96* (2013.01); *F05D 2260/97* (2013.01)

(58) Field of Classification Search
CPC ..... F01D 9/065; F01D 25/04; F01D 25/28; F05D 2220/323; F05D 2240/12; F05D 2240/128; F05D 2250/30; F05D 2260/96; F05D 2260/97
See application file for complete search history.

(56) References Cited

U.S. PATENT DOCUMENTS

| | | | | |
|---|---|---|---|---|
| 6,905,303 | B2 * | 6/2005 | Liu | F04D 29/544 415/142 |
| 7,444,802 | B2 * | 11/2008 | Parry | F04D 29/544 60/226.1 |
| 8,061,969 | B2 | 11/2011 | Durocher et al. | |
| 8,561,414 | B1 | 10/2013 | Praisner et al. | |
| 8,678,760 | B2 * | 3/2014 | Clemen | F02K 3/06 415/211.2 |
| 9,556,746 | B2 * | 1/2017 | Paradis | F01D 9/042 |
| 9,759,234 | B2 * | 9/2017 | Domereq | F01D 5/146 |
| 9,909,434 | B2 * | 3/2018 | Tsifourdaris | F01D 9/04 |
| 10,221,720 | B2 * | 3/2019 | Nolcheff | F02C 7/042 |
| 2013/0259672 | A1 * | 10/2013 | Suciu | F01D 1/04 415/208.1 |
| 2015/0044032 | A1 * | 2/2015 | Paradis | F01D 25/246 415/134 |
| 2015/0260103 | A1 | 9/2015 | Yu et al. | |

FOREIGN PATENT DOCUMENTS

| | | | |
|---|---|---|---|
| DE | 102007025006 | A1 | 4/2008 |
| EP | 1483482 | B1 | 12/2004 |
| EP | 1655457 | B1 | 1/2008 |
| EP | 2775098 | A2 | 9/2014 |
| EP | 2975213 | A1 | 1/2016 |
| EP | 3112613 | A1 | 1/2017 |
| EP | 3121383 | A1 | 1/2017 |
| GB | 476222 | A | 12/1937 |
| GB | 2226600 | A | 7/1990 |

OTHER PUBLICATIONS

Spataro, R. et al., "Development of a Turning Mid Turbine Frame with Embedded Design—Part I: Design and Steady Measurements," ASME 2014.

Spataro, R., "Development of a Turning Mid Turbine Frame with Embedded Design—Part II: Unsteady Measurements," ASME 2014.

Bader, P. et al., "Unsteady CFD Simulation of a turning mid turbine frame with embedded design," Proceedings of 11th European Conference on Turbomachinery Fluid dynamics & Thermodynamics, ETC11, Mar. 23-27, 2015, Madrid, Spain.

* cited by examiner

FLOW CHANNEL FOR A TURBOMACHINE

BACKGROUND OF THE INVENTION

The present invention relates to a method for designing a flow channel for a turbomachine as well as a flow channel and a turbomachine, in particular, a gas turbine, having the flow channel.

Known from U.S. Pat. No. 8,061,969 B2 is a mid turbine frame that has support struts and a guide vane cascade downstream thereof and a number of guide vanes that is larger than the number of support struts or hollow profiles.

BACKGROUND OF THE INVENTION

An object of an embodiment of the present invention is to improve a turbomachine.

This object is achieved by a method and a flow channel of the present invention. A turbomachine having at least one flow channel of the present invention and advantageous embodiments of the present invention are discussed in detail below.

In accordance with an embodiment of the present invention, a flow channel for a turbomachine, in particular of a turbomachine, in particular for (of) an axial turbomachine, in particular a gas turbine, in particular of an aircraft engine, includes: a guide vane cascade having a plurality of guide vanes, which are distributed or are arranged side by side or in succession in the peripheral direction for flow diversion, and which have flow passages, each of which is bounded by two successive (vanes of these) guide vanes; and a support rib arrangement having one or a plurality of support rib(s), which, in one embodiment, connects or (each of which) connect a radially inner casing surface and a radially outer casing surface of the flow channel to each other, and, in particular, supports or support them against each other or for this purpose, or is or are set up or is or are used for the transfer of compressive loads and/or tensile loads, and/or is or are firmly connected to a housing of the turbomachine.

In one embodiment, an axial direction is parallel to an axis of rotation or (main) machine axis of the turbomachine; the peripheral direction is, correspondingly, in particular, a direction of rotation (of a rotor or of at least one rotating blade cascade following the guide vane cascade) of the turbomachine; and a radial direction is, in particular, perpendicular to said axial direction and peripheral direction. In one embodiment, a first element is downstream from a second element when the first element is situated (axially) closer to an outlet of the flow channel or of the turbomachine than the second element. Accordingly, in one embodiment, a first element is upstream of a second element when the first element is situated (axially) closer to an inlet of the flow channel or of the turbomachine than the second element.

In one embodiment, the support rib or one or a plurality of the support ribs has or have an outer profile, in particular a symmetric or asymmetric outer profile that reduces the flow resistance; in one enhancement, the support rib (each of the support ribs) is clad with a hollow profile that reduces the flow resistance; in one enhancement, the outer profile, which reduces the flow resistance, is formed integrally with a core of the support rib. In this way, in one embodiment, it is advantageously possible to reduce a pressure loss and/or a vibrational stimulation. In one embodiment, the guide vanes of the guide vane cascade each have a pressure side and a suction side, which differs from the former, for flow diversion.

In accordance with one embodiment of the present invention, in designing the flow channel, a layout of at least one (of the) flow passage(s) that is situated downstream of a support rib and, in particular, is adjacent to it, is or will be adapted to this support rib in such a way that a pressure loss, in particular, at least between an upstream leading edge of the support rib and a downstream trailing edge of one of the guide vanes bounding this flow passage, and/or a vibrational stimulation, in particular of the support rib, the guide vanes bounding the flow passage, and/or a rotating blade cascade that axially follows the guide vane cascade, will be or is reduced and, in particular, will be or is minimized; in one enhancement, for at least the majority of all successive support ribs of the support rib arrangement in the peripheral direction, in each case, a layout of a flow passage of the guide vane cascade, which is situated downstream of this support rib and, in particular, is adjacent thereto, is or will be adapted to this support rib, in order to reduce and, in particular, to minimize a pressure loss and/or a vibrational stimulation.

In one embodiment, the support rib(s) and the flow passage(s) situated downstream thereof or the upstream leading edges of the guide vanes bounding them are spaced apart axially or by an axial gap.

Additionally or alternatively, in one embodiment for the support rib (each of the support ribs), a distance of this support rib, in particular of its downstream trailing edge, to the flow passage situated downstream thereof, the layout of which is or will be adapted to this support rib for the reduction of a pressure loss and/or of a vibrational stimulation, in particular in the axial direction and/or in the peripheral direction, is less than to all other flow passages of the guide vane cascade. In other words, in one embodiment, in particular, for at least the majority of all successive support ribs of the support rib arrangement in the peripheral direction, in each case, a or the flow passage situated downstream of a support rib, the layout of which is or will be adapted to this support rib for the reduction of a pressure loss and/or of a vibrational stimulation at this support rib, (in each case) is the flow passage of the guide vane cascade nearest to or adjacent to this support rib downstream behind the support rib arrangement.

In this way, in one embodiment, it is possible to improve an efficiency and/or a service life of the turbomachine.

In one embodiment, the adaptation of the layout of one flow passage, or a plurality of the flow passages (in each case) situated downstream of a support rib, to this support rib, so as to reduce a pressure loss and/or a vibrational stimulation, comprises (in each case) a positioning of this flow passage in the peripheral direction in relation to this support rib in such a way that a trailing segment of the support rib and/or a tangent at a point of a downstream end region of a camber line of the support rib intersects an inlet cross section of the flow passage in a middle region of the inlet cross section.

Accordingly, in one embodiment, for at least one (of the) support rib(s), in particular, for at least the majority of all successive support ribs of the support rib arrangement in the peripheral direction in each case, a or the flow passage that is situated downstream, and, in particular, adjacent to this support rib, is or will be positioned in relation to this support rib in the peripheral direction in such a way that a trailing segment of the support rib and/or a tangent at a point of a downstream end region of a camber line of the support rib intersects an inlet cross section of the flow passage in a middle portion. In the present instance, for more compact illustration or clear identification, a flow passage that is positioned in such a way in relation to a support rib is also referred to as (the) flow passage furnished with this support rib.

In one embodiment, in a technically conventional way, the trailing segment of a support rib is bounded by the two lines of flow that diverge from sides of the support rib lying opposite each other in the peripheral direction. In one embodiment, in a technically conventional way, the camber line or profile midline of a support rib is the line connecting the center points of circles inscribed in a profile or a cross section of the support rib. In one embodiment, the end region of the camber line extends from a downstream trailing edge of the support rib over at most 25%, in particular at most 10%, in one embodiment at most 5%, of the length of the camber line. In one embodiment, the inlet cross section of a flow passage extends, in particular, in the peripheral direction, between the upstream leading edges of the guide vanes bounding the flow passage; in one embodiment, its middle region extends over at most 80%, in particular at most 60%, and/or at least 10%, in particular at least 25%, of the inlet cross section or of its width in the peripheral direction, and/or is spaced apart equidistantly from the two leading edges of the guide vanes bounding the flow passage (in the peripheral direction).

In this way, in one embodiment, there is an advantageous flow to the guide vane cascade. In this way, in one embodiment, it is possible to reduce especially advantageously a pressure loss and/or a vibrational stimulation.

Additionally or alternatively to such a peripheral positioning, in one embodiment for at least one support rib, in particular for at least the majority of all successive support ribs of the support rib arrangement in the peripheral direction in each case, the adaptation of the layout of the flow passage situated downstream of this support rib to the support rib situated upstream of it, so as to reduce a pressure loss and/or a vibrational stimulation, comprises a change (in each case) in a size and/or shape of this flow passage when compared to one flow passage or a plurality of others of the flow passages of the guide vane cascade, and therefore, in particular, an additional change in a size and/or shape of the support rib or a support rib or a plurality of support ribs of furnished flow passage(s), which, in relation to (one of) the support rib(s), is or are positioned in the peripheral direction in such a way that a trailing segment of the support rib and/or a tangent at a point of a downstream end region of a camber line of the support rib intersects an inlet cross section of the flow passage in a middle region.

Accordingly, in one embodiment for at least one (of the) support rib(s), and, in particular, at least for the majority of all successive support ribs of the support rib arrangement in the peripheral direction in each case, a size and/or shape of a flow passage or the flow passage situated downstream of and, in particular, adjacent to this support rib, the layout of which is or will be adapted to this support rib, is or will be different (in design) from at least one other of the flow passages, and therefore, in particular, additionally, a size and/or shape of the support rib or a support rib or a plurality of support ribs of furnished flow passage(s), which, in relation to (one of the) the support rib(s), is or are positioned in the peripheral direction in such a way that a trailing segment of the support rib and/or a tangent at a point of a downstream end region of a camber line of the support rib intersects an inlet cross section of the flow passage in a middle region, is or will be different (in design) from at least one other of the flow passages and, in particular, is or will be different from at least one other of the flow passages that is not furnished with a support rib and/or is not a flow passage adjacent to a support rib.

By way of such an adaptation or specifically (adapted) profiling of one or a plurality of the flow passage(s) that (each) is or are situated downstream of a support rib, and, in particular, is adjacent to or furnished with a support rib, it is possible, in one embodiment, to reduce especially advantageously a pressure loss and/or a vibrational stimulation.

In one embodiment, this change in the size and/or shape of at least one (of the) flow passage(s), in particular, a flow passage furnished with a support rib, when compared to at least one other (of the) flow passage(s) comprises a change, in particular an enlargement, of a channel width, in particular a mean, maximum, and/or minimum channel width, in the peripheral direction in one embodiment by at least 1% and/or at most 50%, in particular at most 15%.

Accordingly, in one embodiment, for at least one (of the) support rib(s), in particular at least for the majority of all successive support ribs of the support rib arrangement in the peripheral direction in each case, a channel width, in particular a mean, maximum, and/or minimum channel width, in the peripheral direction of the flow passage, the layout of which is or will be adapted to this support rib, in particular to the adjacent flow passage downstream of the support rib, is or will be different (in design) from at least one other of the flow passages, in one embodiment by at least 1% and/or at most 50%, in particular at most 15%, and, therefore, in particular, a channel width of the flow passage or a flow passage or a plurality of flow passage(s), which is or are positioned in relation to (one of the) the support rib(s) in the peripheral direction in such a way that a trailing segment of the support rib and/or a tangent at a point of a downstream end region of a camber line of the support rib intersects an inlet cross section of the flow passage in a middle region is or will be different (in design) from at least one other of the flow passages, in particular from the majority of the other flow passages.

In this way, in one embodiment, a trailing segment of the support rib is directed advantageously into the flow passage. In this way, in one embodiment, it is possible to reduce especially advantageously a pressure loss and/or a vibrational stimulation.

Additionally or alternatively, in one embodiment, the change in the size and/or shape of at least one (of the) flow passage(s), in particular of a flow passage or of flow passages furnished with a support rib, when compared to at least one other (of the) flow passage(s) comprises a change in a pressure side on the side of the flow passage of one of the two guide vanes and/or a change in a flow-passage-side suction side of one of the two guide vanes that bound the one flow passage, and/or a change in a stagger angle and/or in a profile of one of these two guide vanes or of these two guide vanes when compared to the other flow passage or when compared to the guide vane or guide vanes bounding it, and, in particular, when compared to the majority of the other flow passages.

Accordingly, in one embodiment, for at least one (of the) support rib(s), in particular at least for the majority of all successive support ribs of the support rib arrangement in the peripheral direction, in each case, a flow-passage-side pressure side of one of the two guide vanes that bound a flow passage, in particular, furnished with this support rib, the layout of which is or will be adapted to this support rib for reducing a pressure loss and/or a vibrational stimulation, and, in particular, bound a flow passage that is adjacent downstream to this support rib is or will be different (in design) from the flow-passage-side pressure side of one of the two guide vanes that bound another flow passage, in particular, from the flow-passage-side pressure sides of the guide vanes that bound the majority of the other flow passages; and/or a flow-passage-side suction side of one of the two guide vanes that bound, in particular, a flow passage furnished with this support rib, the layout of which is or will be adjusted to this support rib for reducing a pressure loss and/or a vibrational stimulation, and, in particular, bound a flow passage that is adjacent downstream to this support rib is or will be different (in design) from the flow-passage-side suction side of one of the two guide vanes that bound another flow passage, in particular, from the flow-passage-side suction sides of the guide vanes that bound the majority of the other flow passages; and/or a stagger angle of one of the two guide vanes or of both guide vanes that bound, in particular, a flow passage furnished with this support rib, the layout of which is or will be adapted to this support rib for reducing a pressure loss and/or a vibrational stimulation, and, in particular, bound a flow passage that is adjacent downstream to this support rib is or will be different (in design) from a stagger angle of at least one of the guide vanes bounding another flow passage, and, in particular, from the stagger angles of the guide vanes that bound the majority of the other flow passages; and/or a profile of one of the two guide vanes or of both guide vanes that bound a flow passage, in particular, furnished with this support rib, the layout of which is or will be adapted to this support rib for reducing a pressure loss and/or a vibrational stimulation, and, in particular, bound a flow passage that is adjacent downstream to this support rib is or will be different (in design) from a profile of at least one of the guide vanes bounding another flow passage, in particular, from the profiles of the guide vanes that bound the majority of the other flow passages.

In one embodiment, the stagger angle is the angle that the profile chord of the guide vane encloses with the axial or peripheral direction.

In this way, in one embodiment, a trailing segment of the support rib is guided advantageously in the flow passage. In this way, in one embodiment, it is possible especially advantageously to reduce a pressure loss and/or a vibrational stimulation.

In one embodiment, the guide vane cascade of the flow channel is an inlet guide vane cascade of a turbine of a gas turbine, and, in an enhancement, the support rib arrangement is arranged in a mid turbine frame (MTF) for the connection of two turbines of a gas turbine, in particular, a mid turbine frame that connects a high-pressure turbine and a medium-pressure or low-pressure turbine to each other or a medium-pressure and a low-pressure turbine to each other or is set up or used for this purpose.

This represents an especially advantageous application of the present invention.

BRIEF DESCRIPTION OF THE DRAWING FIGURES

Figure 2:
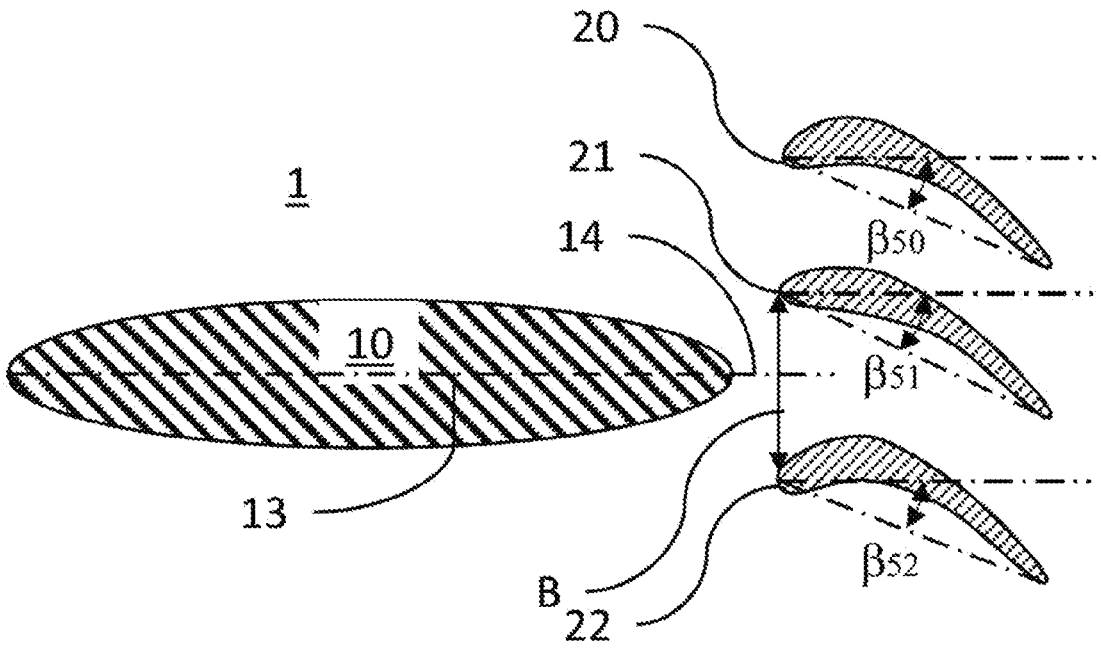

Additional advantageous enhancements of the present invention ensue from the dependent claims and the following description of preferred embodiments. Shown for this purpose, in part schematically, are:

FIG. 1 is a part of a flow channel of a turbomachine in accordance with an embodiment of the present invention; and FIG. 2 is a one part of FIG. 1.

DESCRIPTION OF THE INVENTION

FIG. 1 shows a part of a flow channel 1 of a turbomachine in accordance with an embodiment of the present invention or a design of the flow channel 1 according to a method in accordance with an embodiment of the present invention.

The flow channel 1 has a guide vane cascade with a plurality of guide vanes, which are distributed in the peripheral direction, and flow passages, each of which is bounded by two successive guide vanes, of which, by way of example in FIG. 1, guide vanes 20-24 and flow passages 50-54 bounded (in part) by them are illustrated.

The flow channel 1 further has a support rib arrangement with a plurality of support ribs, which are distributed in the peripheral direction and of which, by way of example in FIG. 1, a support rib 10, for which the flow passage 51 is adjacent downstream, and a support rib 100, for which the flow passage 54 is adjacent downstream, are illustrated.

In the illustrated embodiment of FIG. 1, the support ribs 10, 100 run parallel to the axial direction; that is, they are not arranged or oriented at an inclination to the axial direction. In another embodiment, which is not illustrated, the support ribs 10 and/or 100 are inclined to the axial direction or oriented when compared to the axial direction at an angle of, for example, between 5° and 10°, such as, for instance, 5°, 6°, 7°, 8°, 9°, or 10°.

A layout of these adjacent flow passages 51, 54 downstream of a support rib will be or is adapted in each case to the adjacent support rib 10 or 100 upstream thereof in order to reduce a pressure loss and/or a vibrational stimulation.

For this purpose, the flow passage 51 is or will be positioned in the peripheral direction (vertical in FIG. 1) in relation to the support rib 10 in such a way that a trailing segment 12 (see FIG. 1) or a tangent 14 at a point of a downstream end region of a camber line 13 of the support rib 10 intersects an inlet cross section E of the flow passage 51 in a middle region, as illustrated in FIG. 2. In the same way, the flow passage 54 also is or will be positioned in the peripheral direction in relation to the support rib 100 in such a way that a trailing segment or a tangent at a point of a downstream end region of a camber line of the support rib 100 intersects an inlet cross section of the flow passage 54 in a middle region (not illustrated).

Additionally, a channel width B in the peripheral direction (see FIG. 2) of the flow passage 51 is or will be enlarged when compared to the flow passages 50, 52, and 53.

Additionally, a flow-passage-side pressure side 41 of the guide vane 21, which bounds the flow passage 51, is or will be altered or adapted, in particular, when compared to the flow-passage-side pressure sides 40 and 43 of the guide vanes 20 and 23, respectively, which bound the flow passage 50 or 53, respectively.

Additionally, a flow-passage-side suction side 32 of the guide vane 22, which bounds the flow passage 51, is or will be altered or changed, in particular, when compared to the flow-passage-side suction sides 30 and 33 of the guide vanes 20 or 23, respectively, which bound the flow passage 50 or 53, respectively.

Additionally, the stagger angles 1351, 1352 of the guide vanes 21, 22, which bound the flow passage 51, are or will be altered or adapted, in particular when compared to the stagger angle 1350 of the guide vane 20, which bounds the flow passage 50, as illustrated in FIG. 2.

The same applies analogously to the flow passage 54 or the guide vanes bounding it, of which, in FIG. 1, only the guide vane 24 is shown.

A rotating blade cascade 70 of a turbine or of a compressor is arranged downstream behind the guide vane cascade comprising the guide vanes 20-24. In the case of a turbine, a rotating blade cascade 60 of another turbine is arranged upstream in front of the support rib arrangement comprising the support ribs 10, 100. In the case of a compressor, a compressor guide vane cascade 60 is arranged upstream in front of the support rib arrangement comprising the support ribs 10, 100.

Even though, in the preceding description, exemplary embodiments were explained, it is noted that a large number of modifications are possible. Moreover, it is noted that the exemplary embodiments are only examples, which in no way limit the scope of protection, the applications, and the structure. Instead, the preceding description affords the person skilled in the art a guideline for implementing at least one exemplary embodiment, with it being possible to carry out diverse changes, in particular in regard to the function and arrangement of the described component parts, without departing from the scope of protection as ensues from the claims and the combinations of features equivalent thereto.

It would be appreciated by those skilled in the art that various changes and modifications can be made to the illustrated embodiments without departing from the spirit of the present invention. All such modifications and changes are intended to be covered by the appended claims.

What is claimed is:

1. A method for designing a flow channel for a turbomachine that includes a guide vane cascade having a plurality of guide vanes, which are distributed in the peripheral direction, and flow passages, each of which is bounded by two successive guide vanes, and a support rib arrangement having at least one support rib, wherein a downstream edge of the at least one support rib is axially spaced apart from an upstream edge of the guide vanes, wherein a layout of one of the flow passages is changed in shape relative to one of the other adjacent flow passages by a change in shape of the guide vanes bounding said changed flow passage, which is situated downstream of the at least one support rib, to reduce a pressure loss and/or a vibrational stimulation.

2. The method according to claim 1, wherein, for at least the majority of all successive support ribs of the support rib arrangement in the peripheral direction, in each case, a layout of a flow passage of the guide vane cascade that is situated downstream of this support rib is adapted to this support rib in order to reduce a pressure loss and/or a vibrational stimulation.

3. The method according to claim 1, wherein the adaptation of the layout of at least one of these flow passages to the support rib that it is situated downstream of comprises a positioning of this flow passage in the peripheral direction in relation to this support rib in such a way that a trailing segment and/or a tangent at a point of a downstream end region of a camber line of the support rib intersect or intersects an inlet cross section of the flow passage in a middle region.

4. The method according to claim 1, wherein the adaptation of the layout of at least one of these flow passages to the support rib that it is situated downstream of comprises a change in a size of this flow passage when compared to at least one other of the flow passages.

5. The method according to claim 4, wherein the change in the size comprises an enlargement in a channel width in the peripheral direction, and the change in the shape of the one flow passage when compared to the at least one other flow passage comprises a change in a flow-passage-side pressure side of one of the two guide vanes, a flow-passage-side suction side of one of the two guide vanes that bound the one flow passage, in a stagger angle, or in a profile of at least one of these two guide vanes when compared to the other flow passage when compared to the guide vane or guide vanes bounding it.

6. The method according to claim 1, wherein the guide vane cascade is an inlet guide vane cascade of a turbine of a gas turbine, and the support rib arrangement is arranged in a mid turbine frame for the connection of two turbines of a gas turbine.

7. The method according to claim 1, wherein for at least the majority of all successive support ribs of the support rib arrangement in the peripheral direction, in each case, a flow passage, which is situated downstream of this support rib, and is adjacent, is positioned in relation to this support rib in the peripheral direction in such a way that a trailing tangent at a point of a downstream end region of a camber line of the support rib intersect or intersects an inlet cross section of the flow passage in a middle region, and a size of this flow passage is different from at least one other of the flow passages.

8. The method according to claim 1, wherein the at least one flow channel is configured and arranged in a gas turbine.

* * * * *